United States Patent [19]

Yoshida et al.

[11] Patent Number: 4,869,316

[45] **Date of Patent: * Sep. 26, 1989**

[54] HEAT EXCHANGER

[75] Inventors: Takayuki Yoshida; Kiyoshi Sakuma, both of Shizuoka; Yu Seshimo; Masao Hujii, both of Hyogo, all of Japan

[73] Assignee: Mitsubishi Denki Kabushiki Kaisha, Tokyo, Japan

[ * ] Notice: The portion of the term of this patent subsequent to Aug. 8, 2006 has been disclaimed.

[21] Appl. No.: 74,458

[22] PCT Filed: Oct. 9, 1987

[86] PCT No.: PCT/JP86/00520

§ 371 Date: Aug. 19, 1987

§ 102(e) Date: Aug. 19, 1987

[87] PCT Pub. No.: WO87/02761

PCT Pub. Date: May 7, 1987

[30] Foreign Application Priority Data

| | | | |
|---|---|---|---|
| Oct. 14, 1985 | [JP] | Japan | 60-229309 |
| Oct. 25, 1985 | [JP] | Japan | 60-240079 |
| Oct. 25, 1985 | [JP] | Japan | 60-240080 |
| Oct. 25, 1985 | [JP] | Japan | 60-240082 |

[51] Int. Cl.[4] ..... F28D 1/04

[52] U.S. Cl. ..... 165/151; 165/148; 165/170

[58] Field of Search ..... 165/151, 168, 170, 166, 165/167, 148

[56] References Cited

FOREIGN PATENT DOCUMENTS 131656 10/1977 Japan .
148884 5/1981 Japan .
143697 7/1986 Japan .

*Primary Examiner*—Larry Jones
*Attorney, Agent, or Firm*—Sughrue, Mion, Zinn, Macpeak & Seas

[57] ABSTRACT

A heat exchanger is disclosed, which comprises a plurality of heat-transfer elements (1) placed side by side each of which has more than one through-hole (3) and which are cyclically bent in a generally trapezoidal wave form in the direction of the flow of a fluid, the bends in one heat-transfer element (1) being in phase with those in an adjacent heat-transfer element (1) in such a manner that the main stream of said fluid will flow not through the holes in each of said heat-transfer elements (1) but through the passage formed by adjacent heat-transfer elements (1). This arrangement not only provides improved heat-transfer characteristics; it also serves to offer a lighter product because of the presence of through-holes (3).

11 Claims, 7 Drawing Sheets

HEAT EXCHANGER

TECHNICAL FIELD

The present invention relates to a heat exchanger, in particular to an improvement of the heat-transfer characteristic of a heat-transfer element such as a heat-transfer fin.

BACKGROUND ART

An example of the heat-transfer unit used in a prior art heat exchanger is shown in FIG. 12.

The drawing is a partial perspective view of the conventional heat-transfer unit that is generally indicated by (1) and disposed in the direction of the flow of a fluid (A) (as indicated by the arrows). The heat-transfer element (1) is basically composed of heat-transfer fins, a heat generator, a heat absorber, a heat accumulator, and a heat radiator. In FIG. 6, the heat-transfer unit consists of a plurality of heat-transfer elements (1*a*), (1*b*) and (1*c*) that are stacked one on top of another and the fluid flows through the passage formed by adjacent heat-transfer elements. Each heat-transfer element (1) is cyclically bent in the direction of fluid flow in the form of trapezoidal waves, the bends in one element being in phase with those in an adjacent element.

The heat-transfer unit of the type described above is hereinafter referred to as an imperforate trapezoidally corrugated plate.

FIG. 13 is a partial perspective view of another conventional heat-transfer unit that consists of a plurality of heat-transfer elements (1) in a plane plate form that are disposed in the direction of the flow of a fluid (A) (as indicated by the arrows). This type of heat-transfer unit is hereinafter referred to as parallel plates.

FIG. 2 is a graph showing the heat-transfer characteristics of the two conventional types of heat-transfer unit, in which the characteristics of the imperforate trapezoidally corrugated plate are indicated by ▲ and those of the parallel plates by ○. The symbols on the x- and y-axes of the graph are:

$Re = v \cdot De/\nu$: Reynolds number;

$Nu = h/De/\lambda$: Nusselt number where

- v: maximum velocity of wind passing through the heat-transfer unit;
- De: spacing between heat-transfer surfaces multiplied by a factor of 2;
- h: heat transfer rate;
- $\nu$: fluid dynamic viscosity coefficient; and
- $\lambda$: fluid heat conductivity.

As is clear from FIG. 2, the imperforate trapezoidally corrugate plate type heat-transfer unit shown in FIG. 12 and the parallel-plate type heat-transfer unit shown in FIG. 13 have essentially the same heat-transfer characteristics. In the heat-transfer unit of the type shown in FIG. 12, the fluid flows along the individual heat-transfer elements and this would provide the unit with heat-transfer characteristics which are essentially the same as those exhibited by the parallel-plate type heat-transfer unit.

DISCLOSURE OF THE INVENTION

The heat exchanger of the present invention comprises plurality of heat-transfer elements placed side by side each of which has more than one through-hole and which are cyclically bent in a generally trapezoidal waveform in the direction of the flow of a fluid, the bends in one heat-transfer element being in phase with those in an adjacent heat-transfer element in such a manner that the main stream of said fluid will flow not through the holes in each of said heat-transfer elements but through the passage formed by adjacent heat-transfer elements. Because of this arrangement, the fluid flowing along one surface of each heat-transfer element will be sucked in through the holes and blown out of them to flow along the other surface of the heat-transfer element. In the portion where the fluid is sucked in, the thickness of a temperature boundary layer is reduced and in the portion where the fluid is blown out, replacement of fluid bodies will occur, thereby promoting heat-transfer so as to provide improved heat-transfer characteristics for the heat-transfer elements.

BEST MODE FOR CARRYING OUT THE INVENTION

First Embodiment

Figure 1:
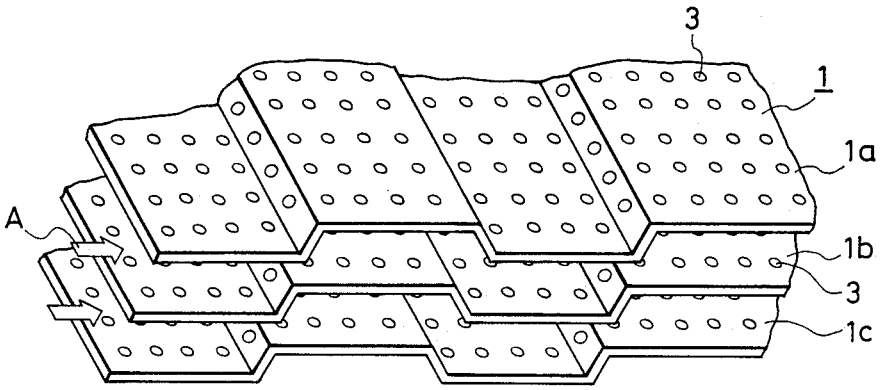
FIG. 1 is a partial perspective view showing a heat-transfer unit according to a first embodiment of the present invention.
Figure 12:
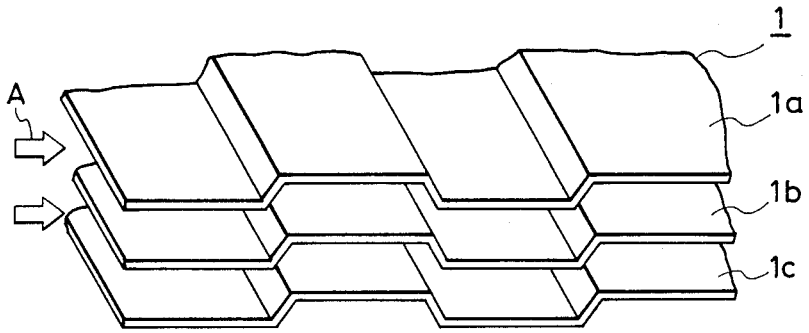
FIG. 12 PRIOR ART
FIGS. 12 and 13 are partial perspective views of two different prior art heat-transfer units.
Figure 13:
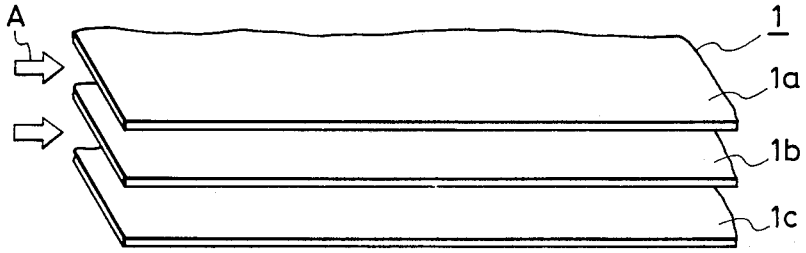
FIG. 13 PRIOR ART

FIG. 1 is a partial perspective view of a heat-transfer unit according to a first embodiment of the present invention. The heat-transfer unit of this embodiment differs from the one shown in FIG. 12 in that a plurality of through-holes (3) are made in individual heat-transfer elements.

Figure 2:
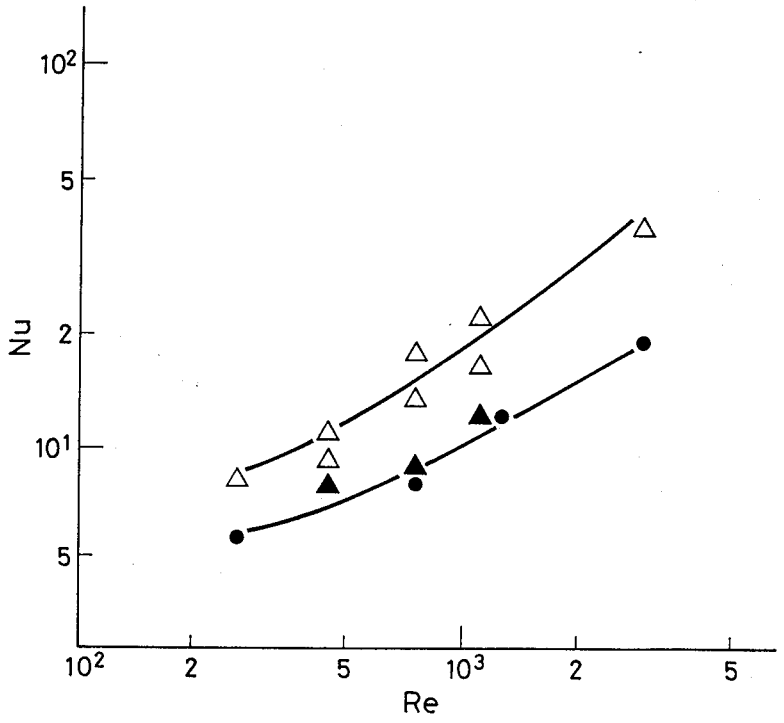
FIG. 2 is a graph showing the heat-transfer characteristics of the heat-transfer unit according to the first embodiment of the present invention, as well as two prior art heat-transfer units.

The heat-transfer characteristics of this heat-transfer unit (1) (hereinafter referred to as a perforated trapezoidally corrugated plate) are shown in FIG. 2 in terms of experimental values by Δ. It can be seen that this heat-transfer unit has improved heat-transfer characteristics over the imperforate trapezoidally corrugated plate shown in FIG. 12.

The reason for this effect would be as follows.

Figure 3A:
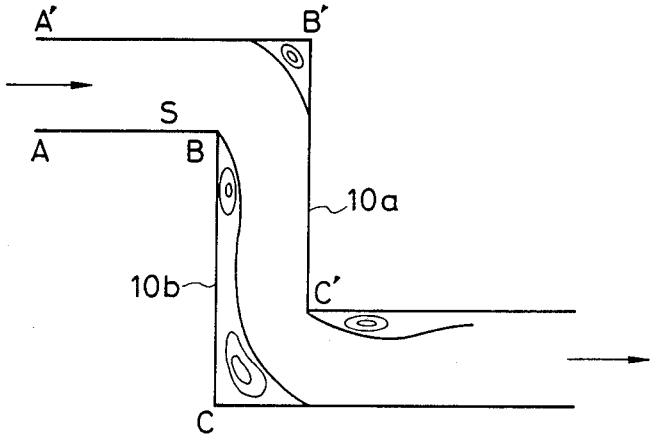
FIG. 3 is an illustration of the profile of pressures on the wall surface of a bent fluid passage as a function of the direction of fluid flow.
Figure 3B:
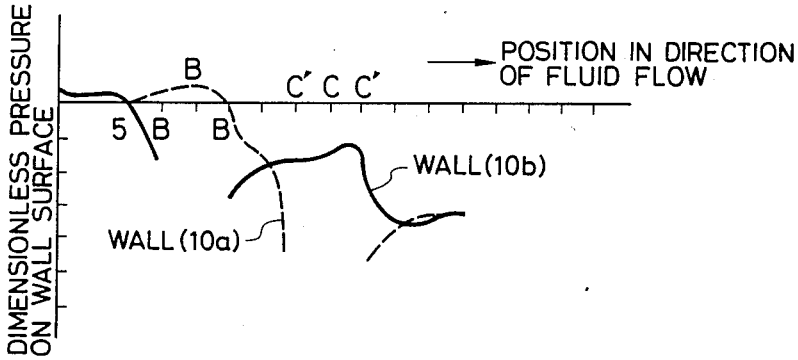

FIG. 3 is an illustration showing how the pressure on the wall surface of a common bent fluid passage will vary in the direction of fluid flow (also see Izumi et al., "Fluid Motion and Heat Transfer in a Corrugated Channel", in Transactions of the Japan Society of Mechanical Engineers, vol. 46, No. 412). FIG. 3(*a*) shows a cross section of the corrugated channel, in which (10*a*) and (10*b*) are each a bent wall.

FIG. 3(*b*) shows the distribution of dimensionless pressure on the surface of each wall in the direction of fluid flow. At the same position in the direction of fluid flow, the pressure on wall (10*a*) is high when the pressure on wall (10*b*) is low, thereby creating a pressure profile for the two walls that varies in opposite directions. Therefore, if fluid channels of the configuration shown in FIG. 3(*a*) are arranged one on top of another, a pressure difference is produced between the two dies (the obverse and reverse side) of each wall of the corrugated channel and as shown in FIG. 3(*b*), this pressure difference is cyclically inverted in the direction of fluid flow.

Because of this mechanism, in the heat-transfer unit (1) shown in FIG. 1, a pressure difference is produced between the two sides (the obverse and reverse sides) of each wall of the corrugated channel at every bent portion and part of the fluid will flow across the wall through holes (3). Therefore, if a heat-transfer unit is constructed in the way shown in FIG. 1, the fluid flowing along one surface of each heat-transfer element will be sucked in through-holes (3) and blown out of them to flow along the other surface of the heat-transfer element, with the surface where the fluid is sucked in alternating with the surface where the fluid is blown out in the direction of fluid flow. In the surface where the fluid is sucked in, the thickness of a temperature boundary layer is sufficiently decreased to achieve significant enhancement of heat-transfer. In the surface where the fluid is blown out, replacement of fluid bodies takes place, which also leads to an improved performance of heat-transfer. These two effects would combine to accomplish dramatic promotion of heat-transfer.

In addition, the heat-transfer unit of the first embodiment of the present invention is so designed that the main stream of the fluid (A) will chiefly flow along the individual heat-transfer elements (1) with only a small amount of the fluid flowing through the holes (3) as a branch stream.

In other words, in one cycle of bends in each heat-transfer element (1), the greater part of the fluid will flow through the same passage on one surface of the element and only a limited portion of the fluid will flow across the element through-holes (3). As a result, the main stream of the fluid will flow undeflected along the individual heat-transfer elements (1).

Second Embodiment

Figure 4:
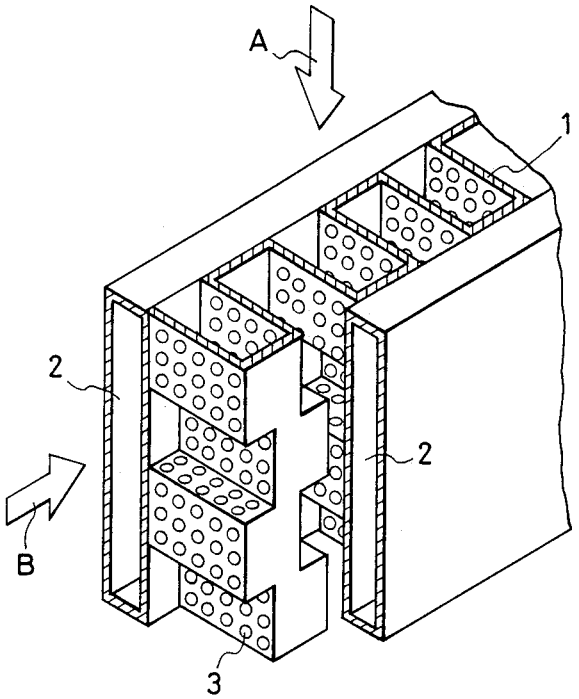
FIGS. 4 and 5 are a partial cutaway view and a partial cross-sectional view of heat-transfer units according to a second and a third embodiment, respectively, of the present invention.

FIG. 4 is a partial cutaway view of a heat exchanger according to a second embodiment of the present invention which is a corrugated fin type heat exchanger commonly used as a radiator in such applications as automobiles.

In FIG. 4, (1) is a first heat-transfer unit of the same type as used in the first embodiment which consists of a plurality of heat-transfer elements each of which has more than one through-hole (3) and which are cyclically bent in a generally trapezoidal waveform in the direction of the flow of a secondary fluid (A) such as air, the bends in one heat-transfer element being in phase with those in an adjacent heat-transfer element, and (2) is a second heat-transfer unit that has a temperature difference form the first heat-transfer unit (1) and which is in the form of a water pipe through which a primary fluid (B) such as engine cooling water flows. The water pipe (2) is positioned normal to the direction of the flow of the secondary fluid (A). The first heat-transfer unit (1) is thermally coupled to the second heat-transfer unit (2) so that heat exchange will take place between the primary fluid (B) and the secondary fluid (A).

Third Embodiment

Figure 5:
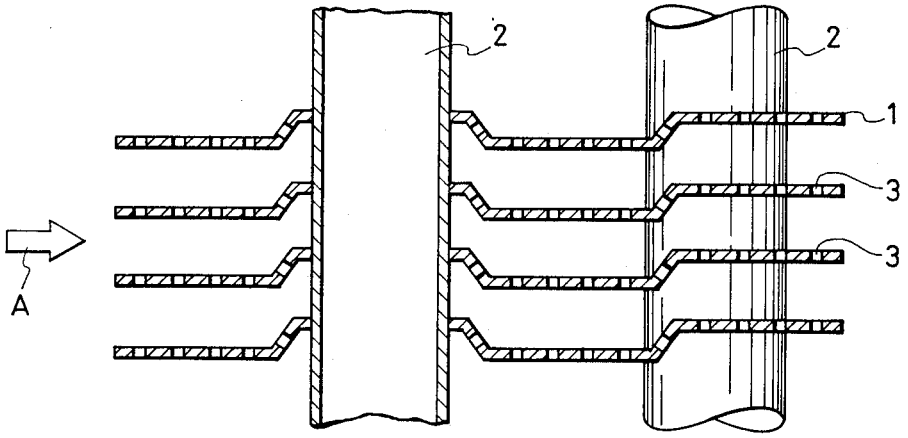

FIG. 5 is a partial cross-sectional view of a heat exchanger according to a third embodiment of the present invention which is a plate fin type heat exchanger for use in air-conditioning. In FIG. 5, a pipe serving as a second heat-transfer unit (2) passes through a first heat-transfer unit (1) of the same type as used in the second embodiment and is positioned normal to the direction of flow of fluid (A).

In the heat exchangers of the types shown in FIGS. 4 and 5, the second heat-transfer unit (2) through which the primary fluid (B) flows generally has good heat-exchanging characteristics because water is typically used as the primary fluid (B), and it is the heat-transfer fins, or the first heat-transfer unit (1) through which the secondary fluid (A) such as air flows; the are desired to be improved in terms of heat-transfer characteristics. Heat exchangers having improved performance in this respect can be attained by providing through-holes (3) in the same way as described in connection with the previous embodiments of the present invention.

Fourth Embodiment

A fourth embodiment of the present invention is hereinafter described with reference to FIG. 6. In this embodiment, the heat-transfer unit (1) is designed to meet certain dimensional specifications.

Figure 6:
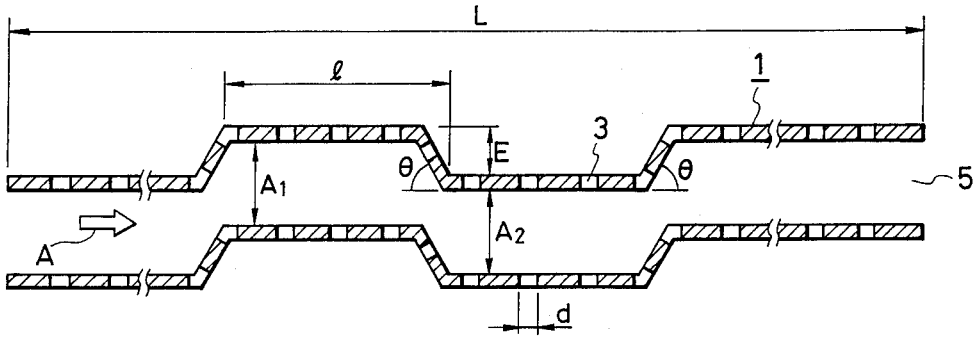
FIG. 6 is a partial cross-sectional view of heat-transfer units according to a fourth, a fifth and a sixth embodiment of the present invention.

FIG. 6 is an enlarged cross section of FIG. 1 and the components which are the same as those shown in FIG. 1 are identified by like numerals.

In FIG. 6, l signifies the projected length of the heat-transfer surface of a heat-transfer element (1) which is in the area corresponding to one half cycle of a series of generally trapezoidal bends formed in the direction of fluid flow, the projection being made normal to the direction of fluid path, and L denotes the overall length of the heat-transfer unit.

First, the periodicity of trapezoidal forms is explained. the method of the present invention for achieving accelerated heat-transfer is chiefly based on the heat-transfer promoting effect of uniform sucking and blowing of a fluid but at the same time, the effect of repeated approach zones due to the cyclic changes of a temperature boundary layer that result from the fluid coming into and out of the heat-transfer unit would also be significant. In other words, length l rather than the periodicity of trapezoidal forms would cause a predominant effect. Based on this understanding, the present inventors formulated the results of their heat-transfer experiments in terms of l/L, the ratio of length l to the length L of heat-transfer unit (1).

Figure 7:
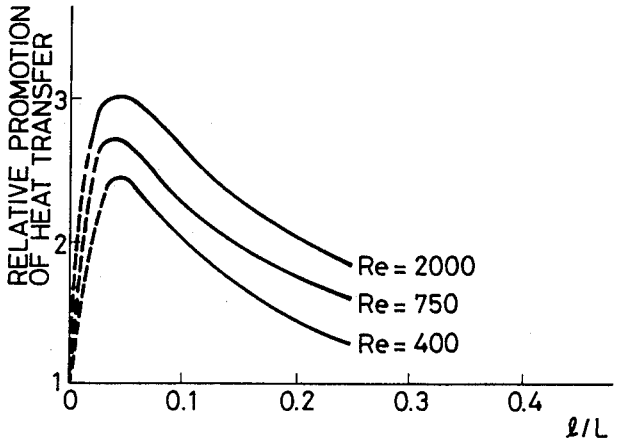
FIG. 7 is a characteristic diagram showing the relative promotion of heat-transfer as achieved in the fourth embodiment of the present invention.

The results of an experiment conducted in air to investigate the relationship between the value of l/L and the relative promotion of heat transfer are shown in the characteristic diagram of FIG. 7, in which the y-axis represents the relative promotion of heat transfer and the x-axis the value of l/L, with the Reynolds number Re being taken as a parameter.

In FIG. 7, Re (basically representing the magnitude of fluid velocity) is given by:

$$Re = \frac{2 \times \text{(average spacing of fins)} \times \text{(fluid velocity as defined in terms of average spacing of fins)}}{\text{dynamic viscosity coefficient of air}}$$

The relative promotion of heat-transfer, taken against the case of parallel plates in which the heat-transfer unit consists of a plurality of parallel plane plates are arranged together, is given by:

$$\text{Relative promotion of heat transfer} = \frac{\text{average Nusselt number for the case of interest}}{\text{average Nusselt number for parallel plates}}$$

The average Nusselt number Nu is a dimensionless number that represents heat-transfer rate and is given by:

$$Nu = \frac{\text{(average heat-transfer rate)} \times 2 \times \text{(average spacing of fins)}}{\text{thermal conductivity of air}}$$

As is clear from FIG. 7, the profile of the relative promotion of heat transfer vs l/L is curved upward and in the range of l/L 0.25, the heat-transfer rate of the system of the present invention is at least 1.5 times as high as the value for the parallel plates. This characteristic is substantially independent of the Reynolds number Re, as well as of other shape parameters although not shown in FIG. 7. Therefore, for the purposes of the present invention, l/L is suitably at 0.25 and below.

The following are the dimensional ranges desired for other shape parameters.

(a) diameter of through-holes (3): 0.5–6 mm
(b) relative opening of through-hole (3) (area of through-holes relative to the area of an individual heat-transfer element: 0.05–0.40
(c) average distance between heat-transfer elements (1):
  1–2 mm (for small-size unit such as one used for residential air-conditioning)
  6–10 mm (for medium-size unit).

The reason for the conclusion stated above with reference to FIG. 7 would be that through-holes (3) which provide passages for fluid flow across a heat-transfer element also serve as restarting points for the development of a temperature boundary layer (a so-called repetition effect of approach zones). As a result, the shorter the length (l) of the area where such through-holes exist, the greater the effect for the promotion of heat-transfer.

However, if the value of l is too small, the heat-transfer characteristics of the system under discussion will approach those of parallel plates and the relative promotion of heat-transfer that is achieved is decreased rather than increased. In addition, for practical reasons of machining, approximately 3 mm is the lower limit of l.

For attaining an effective and desirable relative promotion of heat transfer l/L is advantageously 0.3 and below, with l desirably ranging from 3 mm up to about 50 mm in practical situations.

Fifth Embodiment

A fifth embodiment of the present invention is hereunder described with reference to FIG. 6. In this embodiment, the size (diameter), d, of each of the through-holes (3) in an individual heat-transfer element (1) is specified to be within a certain range. If the relative opening of through-holes (3), or the proportion of the heat-transfer element (1) taken by the opening of the holes, is written as $\beta$, and the widths of adjacent fluid paths as $A_1$ and $A_2$ (in the case shown, $A_1=A_2$), $A_1$ $(A_2)=6$ mm, $l=15$ mm, $L=100$ mm and $\beta=12.5\%$ in the embodiment under discussion.

The method of the present invention for achieving accelerated heat-transfer is largely based on the heat-transfer promoting effect of a static pressure difference that is created between adjacent fluid paths to have part of the fluid flow across a heat-transfer element through-holes (3), and the size, d, of each through-hole (3) would have a strong effect on the characteristics of heat-transfer promotion.

Therefore, the present inventors investigated the relationship between the value of hole diameter, d, and the relative promotion of heat-transfer by experimentation in air. The results of the experiment are shown in FIG. 8.

Figure 8:
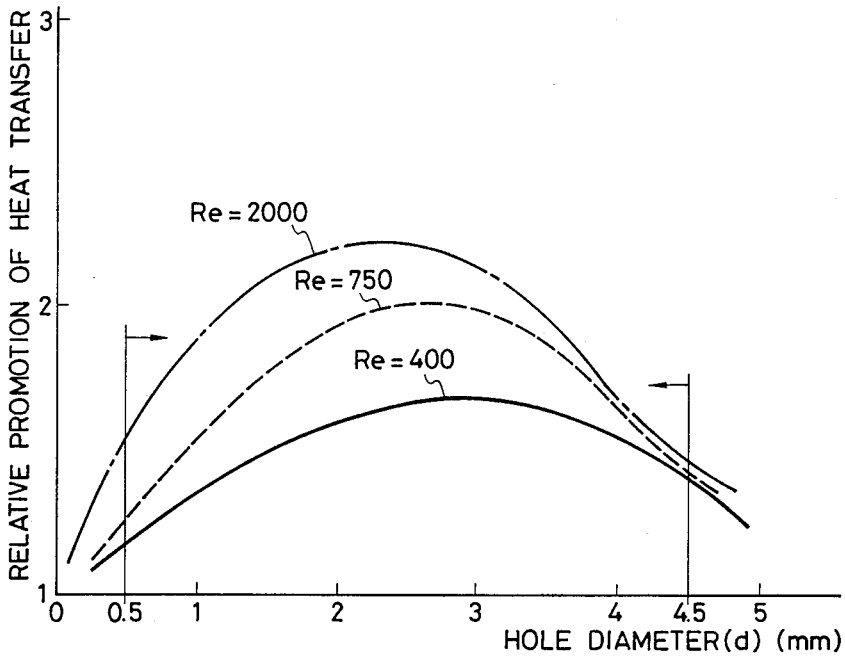
FIG. 8 is a characteristic diagram showing the relationship between the diameter of through-holes in the heat-transfer unit of the fifth embodiment and the relative promotion of heat-transfer achieved.

In FIG. 8, the parameter Re is given by:

$$Re = \frac{(A_1 + A_2) \times \left[\text{fluid velocity as defined in terms of } \frac{A_1 + A_2}{2}\right]}{\text{dynamic viscosity coefficient of air}}$$

The y-axis in FIG. 8, represents the relative promotion of heat transfer, which is defined as:

$$\text{Relative promotion of heat-transfer} = \frac{\text{average Nusselt number for the case of interest}}{\text{average Nusselt number for parallel plates}}$$

The average Nusselt number $\overline{Nu}$ is a dimensionless number that represents heat-transfer rate and is given by:

$$Nu = \frac{2 \times \text{(average heat-transfer rate)} \times \left(\frac{A_1 + A_2}{2}\right)}{\text{thermal conductivity of air}}$$

The characteristic shown in FIG. 8 is substantially independent of Re (basically representing the magnitude of fluid velocity), as well as of other shape parameters although not shown in FIG. 8. According to the experiment conducted by the present inventors, characteristics similar to that shown in FIG. 8 were obtained when the relative opening of through-holes (3) was in the range of 0.05–0.4 and l/L being 0.25 or below.

According to FIG. 8, the profile of the relative promotion of heat-transfer vs hole diameter, d, is curved upward and in the range of d=0.5–4.5, the heat-transfer rate of the system of the present invention is at least 1.5 times as high as the value for the parallel plates.

This would be explained as follows: even if the relative opening $\beta$ is constant, each heat-transfer element (1) has a finite plate thickness, and as the hole diameter, d, decreases, the resistance of through-holes (3) to fluid flow increases to such an extent that given a constant static pressure difference between adjacent fluid paths, a smaller amount of fluid will flow through holes (3) to cause a corresponding decrease in the relative promotion, d, increases to a certain degree, the resistance to fluid flow of through-holes (3) having a constant value of $\beta$ will remain constant, but if the value of, d, increases progressively, the pitch or the spacing of adjacent through-holes (3) also increases and the mechanism of heat-transfer promotion described in connection with the first embodiment can no longer be maintained with a subsequent drop in the relative promotion of heat-transfer. For these two reasons, there would be an appropriate value for the diameter, d, of an individual through-hole.

In other words, it can be seen that for effectively increasing the relative promotion of heat-transfer, d is desirably within the range of 0.5–4.5 mm.

Even in the case of through-holes which are not circular in cross section, it goes without saying that comparable results will be attained if the area of such non-circular holes is within the range of areas that have equivalent diameters within the above-specified range.

.Sixth Embodiment

A sixth embodiment of the present invention is hereunder described with reference to FIG. 6. This embodiment is characterized in that the relative opening of through-holes, $\beta$, is specified to be within a certain range. In this embodiment, the bends in one heat-transfer element are made in phase with those in an adjacent heat-transfer element, so that the distance, $A_1$ or $A_2$, between adjacent heat-transfer elements (1) is generally constant, with $A_1$ being equal to $A_2$.

As already mentioned, the method of the present invention for achieving accelerated heat transfer is largely based on the heat-transfer promoting effect of a static pressure difference that is created between adjacent fluid paths to have part of the fluid flow across a heat-transfer element through-holes (3) and, in this sense, the relative opening $\beta$ of through-holes (3) is a factor that directly governs the volume of fluid flow. Therefore, it is assumed that $\beta$ will have a very great effect on heat-transfer characteristics.

Figure 9:
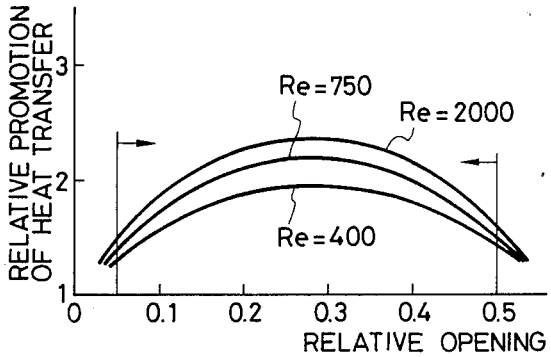
FIG. 9 is a characteristic diagram showing the relationship between the amount of opening in the heat-transfer unit of the sixth embodiment and the relative promotion of heat-transfer achieved.

The results of an experiment conducted in air to investigate the relationship between the value of $\beta$ and the relative promotion of heat-transfer are shown in FIG. 9.

In FIG. 9, the parameter Re is given by:

$$Re = \frac{(A_1 + A_2) \times \left[\text{fluid velocity as defined in terms of } \frac{A_1 + A_2}{2}\right]}{\text{dynamic viscosity coefficient of air}}$$

and the results for Re=400, 750 and 2,000 are depicted. The y-axis in FIG. 9 represents the relative promotion of heat-transfer with the loss of heat-transfer area due to through-holes being taken into account and is given by:

$$\text{Relative promotion of heat-transfer} = \frac{\text{average Nusselt number for the case of interest}}{\text{average Nusselt number for parallel plates}} \times (1 - \beta).$$

The average Nusselt number $\overline{Nu}$ is a dimensionless number that represents heat-transfer rate and is given by:

$$Nu = \frac{2 \times (\text{average heat-transfer rate}) \times \left(\frac{A_1 + A_2}{2}\right)}{\text{thermal conductivity of air}}.$$

The characteristics shown in FIG. 9 is substantially independent of Re (basically representing the magnitude of fluid velocity), as well as of other shape parameters although not shown in FIG. 9.

According to FIG. 9, the profile of the relative promotion of heat-transfer vs relative opening $\beta$ is curved upward and°in the vicinity of $\beta$=0.05–0.5, the heat-transfer rate of the system of the present invention is approximately twice the value for the parallel plates.

If evaluated without taking into account the loss of heat-transfer area due to the presence of through-holes (3), the relative promotion of heat transfer increases gradually as the relative opening, $\beta$, and hence the volume of fluid flow through-holes (3), increases.

However, the increase in relative opening $\beta$ results in the decrease in heat-transfer area and evaluation of relative promotion of heat-transfer taking this loss of heat-transfer area into account provides the result shown in FIG. 9.

The profile of relative promotion of heat-transfer shown in FIG. 9 is the one which is observed in practical operations, so it can be seen that for achieving effective relative promotion of heat-transfer, the relative opening $\beta$ is desirably within the range of 0.05–0.5.

Needless to say, completely the same results will be attained even if the through-holes (3) have non-circular cross-sectional forms such as rectangles.

The following are the dimensional ranges desired for other shape parameters.

(a) diameter, d, of through-hole (3): 0.6–6 mm
(b) l/L: no more than 0.3 (l≧2.5 mm)
(c) average distance between adjacent heat-transfer elements (1):
  1–2 mm (for small-size unit such as one used for residential air-conditioning)
  6–10 mm (for medium-size unit).

Seventh Embodiment

Figure 10:
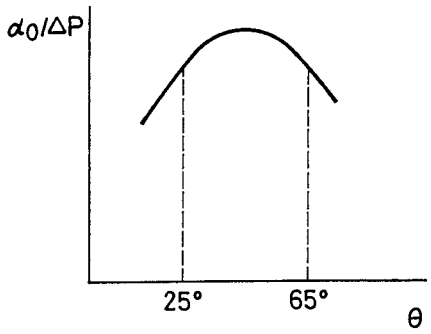
FIG. 10 is a characteristic diagram showing the relationship between the angle of inclination of oblique surfaces in the heat-transfer unit of the seventh embodiment and the ratio of outside-tube heat-transfer coefficient to wind pressure loss.
Figure 11:
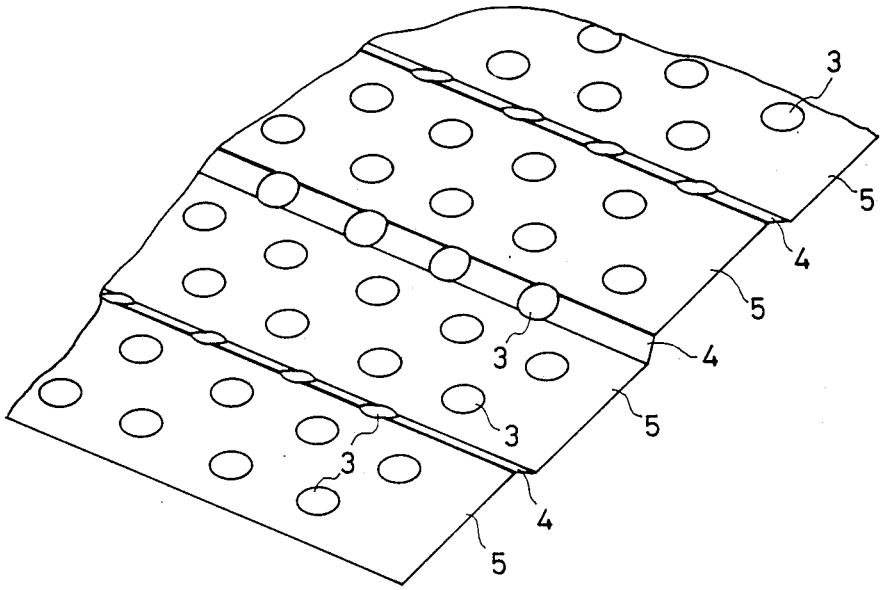
FIG. 11 is a perspective view of the essential parts of a heat-transfer unit according to an eighth embodiment of the present invention.

In this embodiment, each of the trapezoidal bends in a heat-transfer element (1) is so designed that the inclined surfaces thereof will make an angle ($\theta$) of 25–65° with respect to the direction of fluid flow as shown in FIG. 6. It has been found that if this design is adopted, $\alpha/\Delta P$, or the ratio of outside-tube heat-transfer rate to wind pressure loss, which is one of the important factors for the maintenance of the performance of a heat exchanger becomes the highest for the same wind velocity as shown in FIG. 10.

This would be explained as follows: if the angle $\theta$ is too small, the dimension E of a trapezoidal bend taken in the direction of its height becomes smaller than the thickness of a temperature boundary layer formed in the direction of incidence of an air stream, with the subsequent decrease in heat-transfer characteristics; if the angle $\theta$ is excessive, the heat-transfer performance will not be greatly improved and instead the wind pressure loss will increase to cause a drop in the characteristics of the system as a heat exchanger. Another problem associated with the excessive value of $\theta$ is that it impairs structural integrity by increasing the chance of the formation of defective fins during their molding.

Eighth Embodiment

In this embodiment, some of the through-holes (3) are so positioned that they extend across an inclined portion (4) of a heat-transfer element (1) to bridge adjacent flat portions (5).

The through-holes (3) formed in inclined portions (4) of a heat-transfer element (1) chiefly govern the loss of fluid flow whereas the through-holes (3) in flat portions (5) serve to improve heat-transfer performance. Therefore, if through-holes (3) are made at the position defined in the preceding paragraph, there will be no substantial change in heat-transfer performance for the same value of relative opening $\beta$ and instead, the wind pressure loss will be decreased to achieve a consequential improvement in $\alpha/\Delta P$, or the ratio of the outside-tube heat-transfer rate to wind pressure loss. The reason for this decrease in the loss of fluid flow is that air flows into an enlarged portion of a heat-transfer element on the downstream side through such holes (3) so as to decrease the fluid velocity in a reduced portion.

In the fourth to eighth embodiments described above, the values of l/L, l, d, $\beta$, $\theta$, and the position of through-holes (3) in an inclined portion, respectively, are specified as modifications of the first embodiment, and it should be understood that similar modifications can be made to each of the second and third embodiments by incorporating numerical limitations based on the same concept.

Advantages of the Invention

As described in the foregoing, according to the present invention, a plurality of heat-transfer elements each having more than one through-hole and which are cyclically bent in a generally trapezoidal waveform in the direction of the flow of a fluid are placed side by side in such a manner that the bends in one heat-transfer element will be in phase with those in a adjacent heat-transfer element and that the main stream of said fluid will flow not through the holes in each of said heat-transfer elements but through the passage formed by adjacent heat-transfer elements. This arrangement not only provides improved heat-transfer characteristics; it also serves to offer a lighter product because of the presence of through-holes.

What is claimed:

1. A heat exchanger comprising a plurality of heat-transfer elements placed side by side each of which has more than one through-hole and which are cyclically bent in a generally trapezoidal waveform in the direction of the flow of a fluid, the bends in one heat-transfer element being in phase with those in an adjacent heat-transfer element in such a manner that the main stream of said fluid will flow not through the holes in each of said heat-transfer elements but through the passage formed by adjacent heat-transfer elements.

2. A heat exchanger according to claim 1 wherein l/L is set to a value of no more than 0.3, l being the projected length of a heat-transfer element in the area corresponding to one half cycle of a series of trapezoidal bends, the projection being made normal to the direction of fluid path, and L being the length of each heat-transfer element.

3. A heat exchanger according to claim 2 wherein l is at least 2.5 mm.

4. A heat exchanger according to claim 1 wherein the diameter, d, of each of the through-holes is within the range of 0.5–4.5 mm.

5. A heat exchanger according to claim 1 wherein the relative opening, $\beta$, of through-holes is within the range of 0.05–0.5.

6. A heat exchanger according to claim 1 wherein each of the trapezoidal bends in an individual heat-transfer element is such that the inclined surfaces thereof make an angle, $\theta$, of 25°–65° with respect to the direction of fluid flow.

7. A heat exchanger according to claim 1 wherein some of the through-holes are so positioned that they extend across an inclined portion of a heat-transfer element to bridge adjacent flat portions.

8. A heat exchanger according to any one of claims 1 to 7 wherein each of said heat-transfer elements is thermally coupled to a second heat-transfer element having a temperature difference from said first heat-transfer elements.

9. A heat exchanger according to claim 8 wherein said second heat-transfer element passes through the stack of said first heat-transfer elements and is positioned normal to the direction of the flow of the fluid flowing along said first heat-transfer elements.

10. A heat exchanger according to claim 8 wherein said second heat-transfer element is a pipe through which a second fluid flows.

11. A heat exchanger according to claim 9, wherein said second heat-transfer element is a pipe through which a second fluid flows.

* * * * *